US011076632B1

(12) United States Patent
Ormaza

(10) Patent No.: US 11,076,632 B1
(45) Date of Patent: Aug. 3, 2021

(54) TIPS FOR HOUSING ONE OR MORE FLAVORED CAPSULES

(71) Applicant: Manuel Ormaza, Miami, FL (US)

(72) Inventor: Manuel Ormaza, Miami, FL (US)

( * ) Notice: Subject to any disclaimer, the term of this patent is extended or adjusted under 35 U.S.C. 154(b) by 0 days.

(21) Appl. No.: 17/032,920

(22) Filed: Sep. 25, 2020

Related U.S. Application Data

(60) Provisional application No. 62/925,604, filed on Oct. 24, 2019.

(51) Int. Cl.
*A24D 1/00* (2020.01)
*A24C 5/56* (2006.01)

(52) U.S. Cl.
CPC ..... *A24D 1/002* (2013.01); *A24C 5/56* (2013.01)

(58) Field of Classification Search
None
See application file for complete search history.

(56) References Cited

U.S. PATENT DOCUMENTS 3,640,287 A * 2/1972 Pinkham ..... A24D 3/045 131/336
9,907,335 B2 3/2018 Karles
10,212,965 B2 2/2019 Sinclair

FOREIGN PATENT DOCUMENTS

WO WO2020/065031 * 4/2020

OTHER PUBLICATIONS

How to Design a Custom Branded Pre-Roll Filter Tip, https://customconesusa.com/blog/how-to-design-a-custom-branded-preroll-filter-tip/, printed form the internet on Apr. 27, 2021, dated May 3, 2019. (Year: 2019).*

* cited by examiner

*Primary Examiner* — Michael H. Wilson
*Assistant Examiner* — Dionne W. Mayes
(74) *Attorney, Agent, or Firm* — Sanchelima & Associates, P.A.; Christian Sanchelima; Alexander Rodriguez

(57) ABSTRACT

Joint and blunt tips include at least one cut portion made into a corrugated section of the tip. The cut portion provides a suitable width to receive at least one flavor capsule to be nested therein. When rolled, the corrugated section of the tip forms a pattern which prevents the flavored capsule from falling out of the tip when the flavor capsule is crushed. The tip may be provided in a cylindrical tip form or a conical tip form and works with rolling machines. The cut portion may be formed in a vertical or horizontal configuration along the corrugated section of the tip. One embodiment may feature tips which include a cotton or absorbent member inserted within the cut portion nestled with the flavor capsule. Other embodiments include tips with an absorbent layer along the corrugated section to absorb the contents of the flavor capsule when crushed.

8 Claims, 5 Drawing Sheets

TIPS FOR HOUSING ONE OR MORE FLAVORED CAPSULES

OTHER RELATED APPLICATIONS

The present application is a U.S. Non-Provisional Patent Application claiming priority of U.S. Provisional Patent Application Ser. No. 62/925,604 filed on Oct. 24, 2019, which is hereby incorporated by reference.

BACKGROUND OF THE INVENTION

Field of the Invention

The present invention relates to tips used in recreational smoking activities and, more particularly, to joint and blunt tips with a defined structure that allows for the housing of one or more flavored capsules.

Description of the Related Art

Several designs for joint tips have been designed in the past. None of them, however, include tips having at least one cut portion made into a corrugated section of a tip. The cut portion provides a suitable width to receive at least one flavor capsule to be nested therein. When rolled, the corrugated section of the tip forms a pattern which prevents the flavored capsule from falling out of the tip when the flavor capsule is crushed. The tip may be provided in a cylindrical tip form or a conical tip form and works with rolling machines. Furthermore, additional cut portions may be formed into the tip to receive additional flavored capsules. The cut portion may also be formed in a vertical or horizontal configuration along the corrugated section of the tip. One embodiment may feature tips which include a cotton or absorbent member inserted within the cut portion nestled with the flavor capsule. Other embodiments include tips with an absorbent layer along the corrugated section to absorb the contents of the flavor capsule when crushed.

It is known the cigarette filters often include crushable flavor capsules to enhance the smoking pleasure of a user. It is also known that joint tips prevent the burning of one's fingertips and eliminates the need for roach clips. There is a need to implement crushable flavor capsules into joint tips to enhance the smoking pleasure for recreational smokers. Traditional joint tips do not provide the structure needed to support flavor capsules. Therefore, there is a need for joint tips that support crushable flavor capsule to enhance a smoking experience.

Applicant believes that a related reference corresponds to U.S. Pat. No. 9,907,335 issued for improved delivery of additive materials to cigarettes through the use of one or more capsules containing additive materials in the filter section of a cigarette. Applicant believes that another related reference corresponds to U.S. Pat. No. 10,212,965B2 issued for a product and method of making a nested packaged cone with a supporting shape for the consumption of smokable substances such as tabaco and herbs. However, the present invention differs from the present invention because they fail to disclose a cut portion made into a corrugated section of a pre-rolled tip to receive at least one flavored capsule.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a pre-rolled tip for housing at least one flavor capsule which provides a means for safely securing at least one flavor capsule within a tip to enhance the smoking experience for a user.

It is another object of this invention to provide a pre-rolled tip for housing at least one flavor capsule that, when crushed, remains securely within the tip and prevents the capsule from being unintentionally inhaled by a user.

It is still another object of the present invention to provide a pre-rolled tip for housing at least one flavor capsule which can be provided in a cylindrical configuration to work with rolling machines or a conical shape for use with cones.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
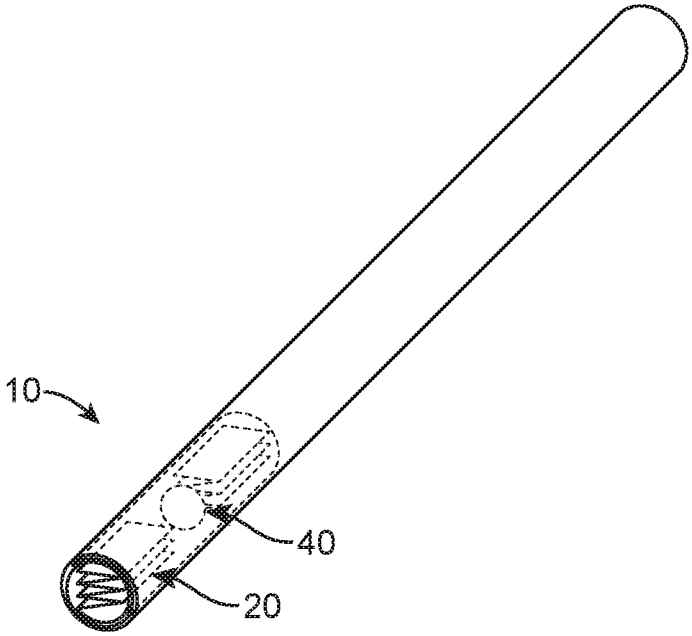
FIG. 1 represents an internal isometric view of a cone having pre-rolled tip 10 having at least one flavor capsule nested therein in accordance to an embodiment of the present invention.

Referring now to the drawings, where the present invention is generally referred to with numeral 10, it can be observed a pre-rolled tip 10 having a tip assembly 20 and a capsule assembly 40.

Figure 2:
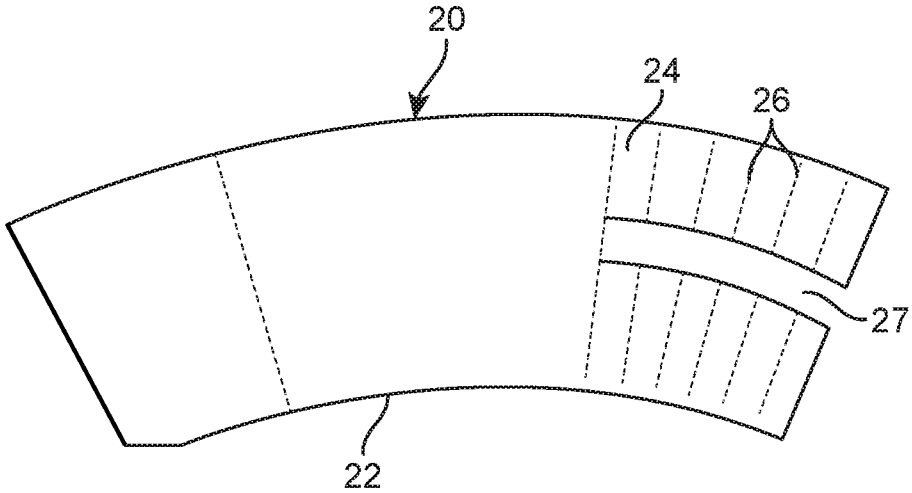
FIG. 2 shows a front view of tip assembly 20 having a trapezoidal tip sheet 22 with a horizontal cut portion in accordance to an embodiment of the present invention.
Figure 3:
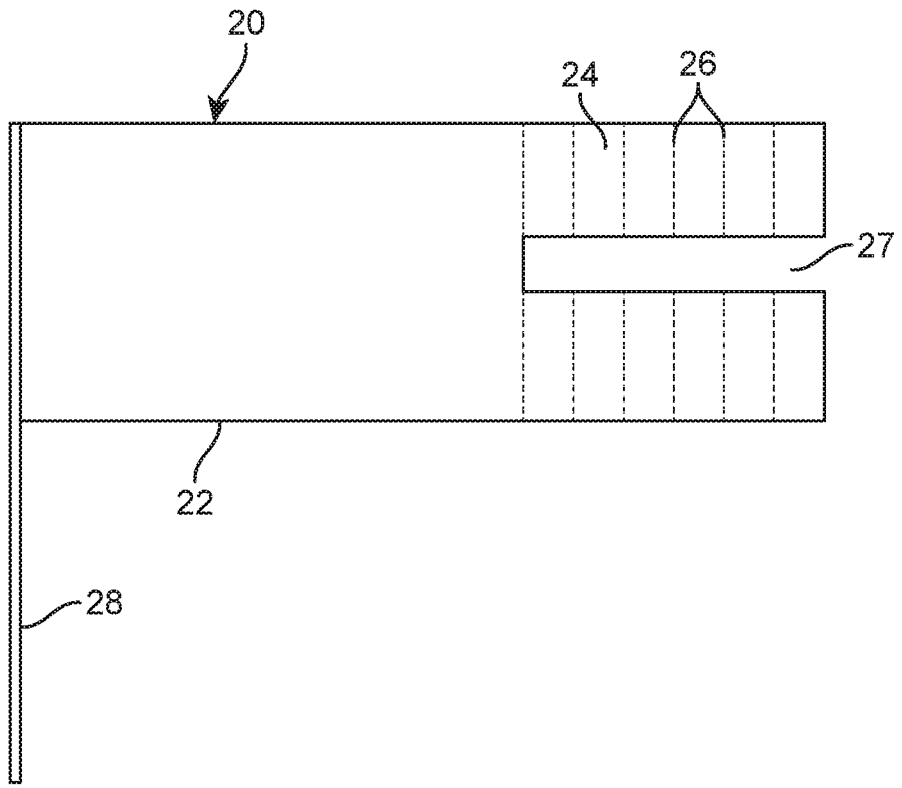
FIG. 3 illustrates a front view of tip assembly 20 having a having a rectangular tip sheet 22 with a horizontal cut portion in accordance to an embodiment of the present invention.
Figure 4:
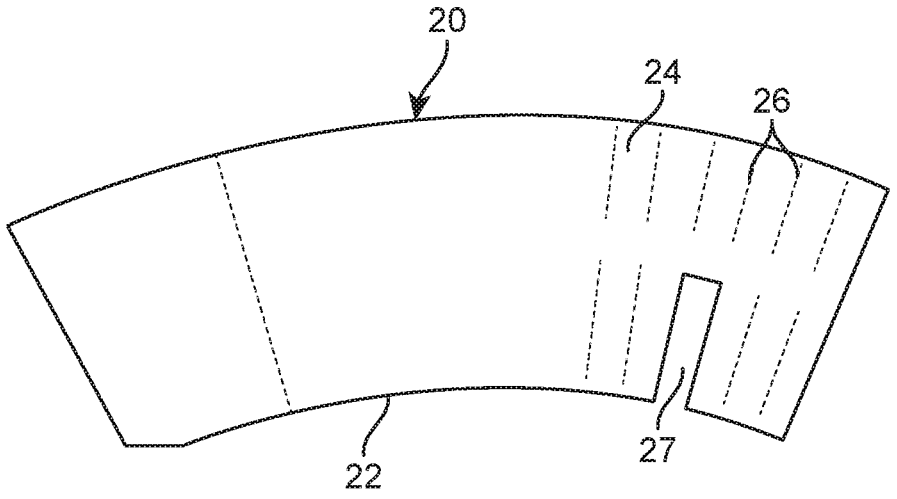
FIG. 4 is a representation of a front view of tip assembly 20 having a trapezoidal tip sheet 22 with a vertical cut portion in accordance to an embodiment of the present invention.
Figure 5:
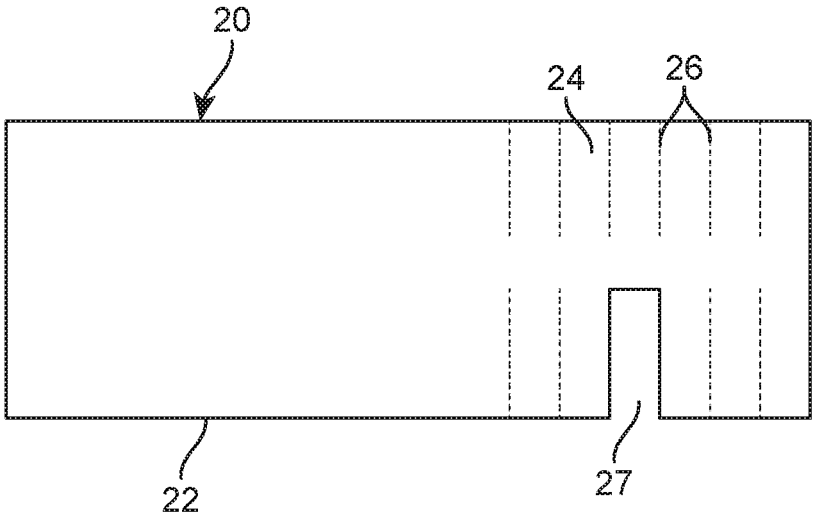
FIG. 5 shows a front view of tip assembly 20 having a rectangular tip sheet 22 with a vertical cut portion in accordance to an embodiment of the present invention.

Tip assembly 20 includes a tip sheet 22 having a pre-rolled configuration as observed in FIGS. 2-5 in accordance to an embodiment of the present invention. In one embodiment tip sheet 22 is made from a standard tip sheet material such as stiff paper that is traditionally used to be placed at the end of a joint where a smoker places their mouth. Traditionally, tip sheet 22 is provided as a uniform sheet which is then formed into a rolled configuration to be placed at the end of a joint. In one embodiment, as depicted in FIGS. 2 and 4, tip sheet 22 may be provided as having a trapezoidal shape. The trapezoidal configuration of tip sheet 22 allows the sheet to be rolled into a conical configuration for use with conical rolling papers. In another embodiment, as depicted in FIGS. 3, and 5, tip sheet 22 may be provided as having a rectangular shape. The rectangular configuration of tip sheet 22 allows the tip to be used with rolling machines and cylindrical rolling papers. In one implementation, tip sheet 22 is provided as being a flavored tip sheet. That is, tip sheet 22 is a sheet infused with a particular flavor as will be described for capsule assembly 40.

Figure 6:
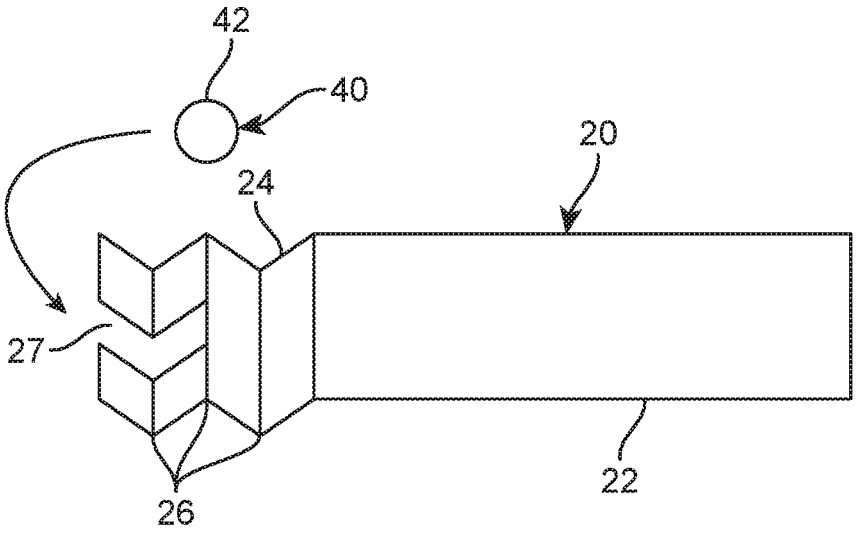
FIG. 6 illustrates a front view of tip assembly 20 receiving capsule assembly 40 in accordance to an embodiment of the present invention.

Tip assembly 20 further includes a corrugated section 24 as observed in FIG. 6 of the provided drawings. It can be observed that corrugated section 24 is a rectangular area of tip sheet 22 that extends from one end of tip sheet 22. Corrugated section 24 only partially covers an area of tip sheet 22 and does not extend across the entire sheet. Other embodiments may feature corrugated sections 24 which encompass a larger area of tip sheet 22. Corrugated section 24 is defined by a plurality of crease lines 26 which can be observed in FIGS. 2-5. Crease lines 26 may be provided as pre-folded vertical creases along the corrugated section 24 which allow a corrugated structure to be formed when the pre-rolled tip is eventually positioned in a rolled configuration. In one implementation, tip sheet 22 further includes a wire handle 28 positioned on a distal end of the sheet opposite to corrugated section 24. Wire handle 28 may be provided as a straight handle structure which aids a user in positioning tip sheet 22 in a rolled configuration. It should be understood, wire handle 28 is an optional addition for tip sheet 22 and is not necessary to enable the present invention.

Tip assembly 20 further includes a cut portion 27 that is made into corrugated section 24 of tip sheet 22. Several embodiments of cut portion 27 may be observed in FIGS. 2-5 of the drawings. As observed in FIGS. 2 and 3, a trapezoidal tip sheet and a rectangular tip sheet 22 is provided with cut portion 27 having a horizontal position. Cut portion 27 may be a rectangular cut section which partially or entirely extends horizontally across corrugated section 24. FIGS. 2 and 3 depict cut portion 27 extending entirely across corrugated section 24 and terminating when met with a non-corrugated section. As observed in FIGS. 4 and 5, a trapezoidal tip sheet and a rectangular tip sheet 22 is provided having a cut portion 27 having a vertical position. Vertical cut portion 27 extends partially along corrugated section 24 in vertical position. Furthermore, cut portion 27 includes a suitable width which cooperates to receive a flavor capsule 42 of capsule assembly 40. It is to be understood that the width of cut portion 27 is dependent on the flavor capsule 42 inserted into the cut portion.

In one embodiment, as depicted in FIG. 6, tip assembly 20 is described as including a tip sheet 22 that is divided into a first portion, a second portion, and a third portion. In this embodiment, the first portion is provided as the portion of the sheet having a uniform flat surface configuration. This is depicted as the right most section of the tip sheet 22 in FIG. 6. Additionally, the second portion is provided as a foldable section having crease lines which form a corrugated section 24. Further, the third portion can be observed in the left most section of FIG. 6. The third portion includes two foldable extensions which are separated by a channel or cut out portion 27. It is observed that the channel starts along a lateral edge of the third portion. As a result, a distal end of the channel is an open end. Furthermore, the proximal end of the channel ends at the lateral edge of the second portion. The channel then receives capsule assembly 40 to be nested therein.

Capsule assembly 40 includes a flavor capsule 42 which contain a liquid substance with a particular flavor. When a crushing force is performed on flavor capsule 42, the liquid substance contained therein is released. Several embodiments of the present invention may present a variety of particular flavors to be infused in the liquid substance within flavor capsule 42. These particular flavors include but are not limited to clove, spearmint, lemon-mint, apple mint, grape, berry, and other flavors. The present invention is not limited to having any one particular flavor. Furthermore, flavor capsule 42 may be provided as a menthol-flavored capsule which allows a smoker to control the strength of the menthol flavor in their smokable. One embodiment of the present invention features flavor capsule 42 having a circular configuration as observed in FIG. 1. However, other shapes for flavor capsule 42 may be used. In one implementation of the present invention, the liquid substance with a particular flavor is directly infused into the tip sheet 22. This provides a tip sheet 22 which further enhances the flavored sensation for a smokable when inhaled by a smoker. Furthermore, the present invention may feature a combination of flavored capsules 42 and flavored tip sheets 22.

Figure 7:
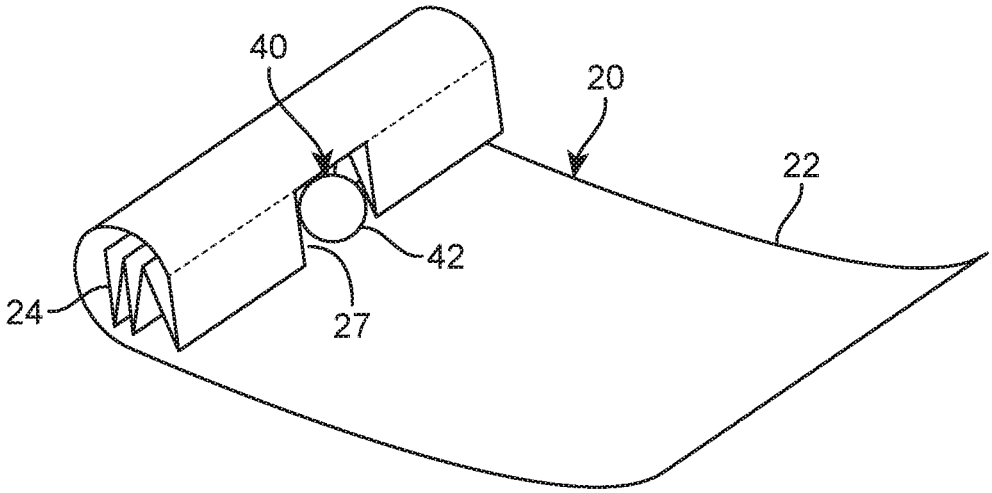
FIG. 7 represents a perspective view of capsule assembly 40 nestled within the corrugated section of tip assembly 40 in accordance to an embodiment of the present invention.

Tip assembly 20 is configured to be positioned into a rolled configuration as observed in FIGS. 1 and 7. It is observed that tip sheet 22 when rolled, defines a corrugated with a particular pattern and a cut portion having a suitable width to receive flavor capsule 42. The particular pattern formed from the rolled configuration of tip sheet 22 is entirely dependent on the preference of a user. Several embodiments of the present invention may feature corrugated sections 24 which forms pattern such as but not limited to spirals, M, W, Z, and other patterns. The present invention is not limited to any one particular pattern for tip assembly 20. Flavor capsule 42 is then nested within cut portion 27 as observed in FIGS. 6 and 7. FIG. 6 depicts flavor capsule 42 being inserted into corrugated structure 24. FIG. 7 depicts tip sheet 22 in a rolled configuration defining corrugated section 24 and cut portion 27. As observed, flavor capsule 42 is nested within cut portion 27 between the corrugated structure formed from corrugated section 24. The present invention features at least one flavor capsule 42 that is nested within cut portion 27. However, other embodiments may feature cut portion 27 nesting more than one flavor capsule 42. One implementation may feature up to four flavor capsules which are inserted within cut portion 27. The flavor capsules 42 may include identical liquid substances with identical particular flavors. Other implementations may feature flavor capsules 42 with varying particular flavors thereby providing new and interesting flavors for a smoker.

Tip assembly 20 is then formed into a rolled tip and placed at the end of a joint as observed in FIG. 1 of the provided drawings. It is observed that flavor capsule 42 is nested within cut portion 27 between corrugated section 24. Corrugated section 24 holds significance to the present invention as it secures the flavor capsule 42. Additionally, corrugated section 24 prevents flavor capsule 42 from falling or escaping out of the assembled tip. Without corrugated section 24, there would be no securement means for flavor capsule 42 and the capsule may easily fall out of the assembled tip. In the present embodiment, the tip is mounted to a joint end as seen in FIG. 1. A user then applies a pressure force to the assembled tip in order to burst capsule 42. The bursting of the flavored capsule 42 then allows the liquid substance therein to be released and moisturize the tip sheet 22 from therein. Corrugated section 24 retains flavored capsule 42 within the rolled tip even when crushed. This will prevent a smoker from accidently inhaling the capsule 42 when taking hits from a smokable.

Figure 8:
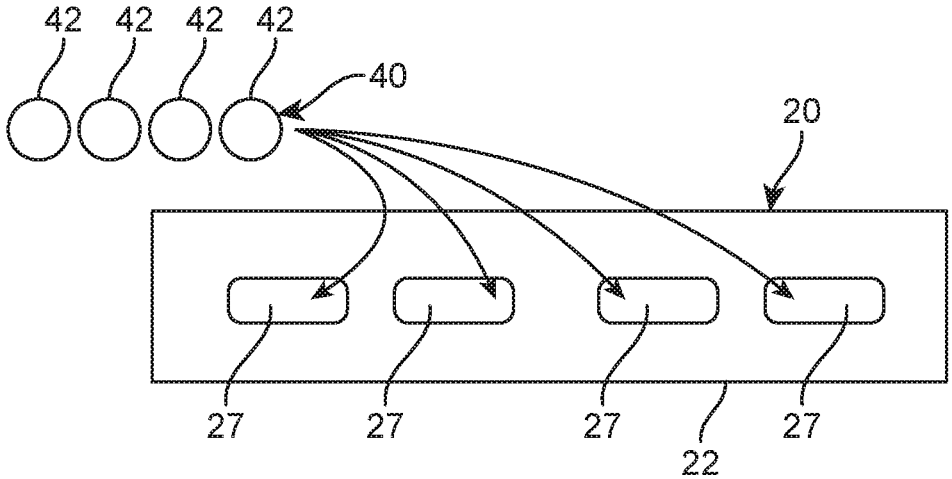
FIG. 8 shows a front view of tip assembly 20 with multiple cut portions receiving capsule assembly 40 with a plurality of capsules in accordance to an embodiment of the present invention.

Another embodiment of the present invention is featured in FIG. 8 of the provided drawings. It is observed a tip sheet 22 having a plurality of cut portions 27 each formed adjacently along the sheet. A plurality of flavor capsules 42 may then be nested within cut portions 27 to securely hold them within the tip. Tip sheet 22 may then be rolled and placed at the end of a joint as previously described.

Figure 9:
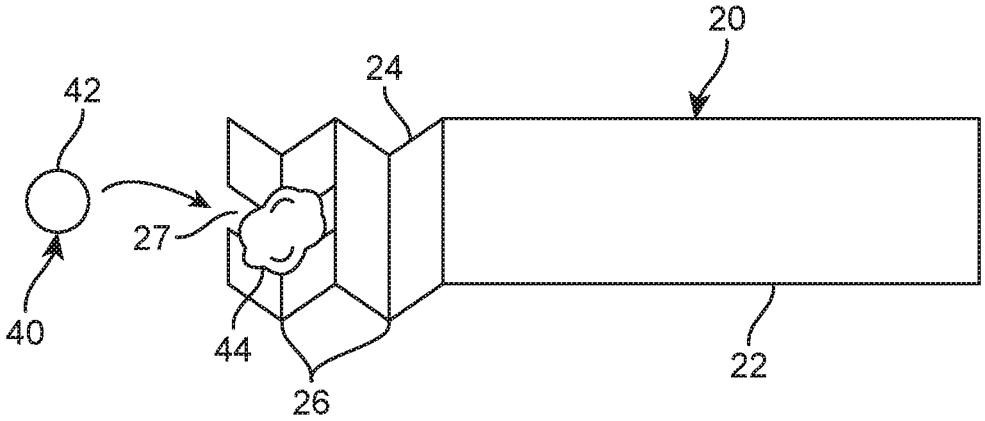
FIG. 9 illustrates a front view of tip assembly 20 receiving capsule assembly 40 with at least one cotton or absorbent material positioned within a cut portion in accordance to an embodiment of the present invention.

Yet another embodiment of the present invention is featured in FIG. 9 of the provided drawings. As observed, a tip sheet 22 having a corrugated section 24 with a cut portion 27 is provided. A cotton or absorbent material 44 is then inserted within cut portion 27. Flavor capsule 42 may then be inserted into the cotton or absorbent material 44 to completely or partially envelop the flavor capsule 42. In another embodiment, the flavor capsule 42 is enveloped by the cotton or absorbent material 44 before nesting the capsule into the cut portion 27. This effectively creates a capsule 42 having an outer layer of cotton or absorbent material. Cotton or absorbent material 44 serves as a moisture retainer for capsule 42 when the liquid substance therein is released. When crushed, the liquid substance will then seep from flavored capsule 42 to then be retained by cotton or absorbent material 44. As a result, the flavored liquid substance is more effectively retained thereby improving the smoking experience for a smoker.

Figure 10:
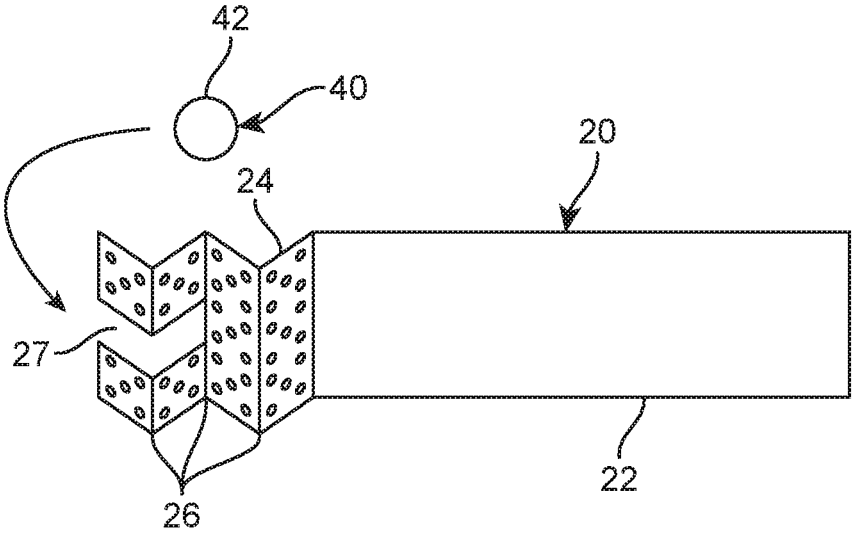
FIG. 10 is a representation of a front view of tip assembly 20 depicting a perforated corrugated section in accordance to an embodiment of the present invention.

FIG. 10 of the provided drawings depicts yet another embodiment of the present invention. In this embodiment, a tip sheet 22 with a corrugated section 24 having cut portion 27 is provided. However, this embodiment features a perforated corrugated section 24. The perforated corrugated section 24 improves the absorbent nature of tip sheet 22 and thereby allowing it to retain more of the flavored liquid from the flavored capsule 42. In one embodiment, the perforations are evenly distributed across the corrugated section 24. In the present embodiment, tip sheet 22 is formed into its rolled configuration and placed at the end of a joint. A user may then crush flavor capsule 42 within the tip. The liquid substance within the capsule is then absorbed by the corrugated section 24 of tip sheet 22.

Figure 11:
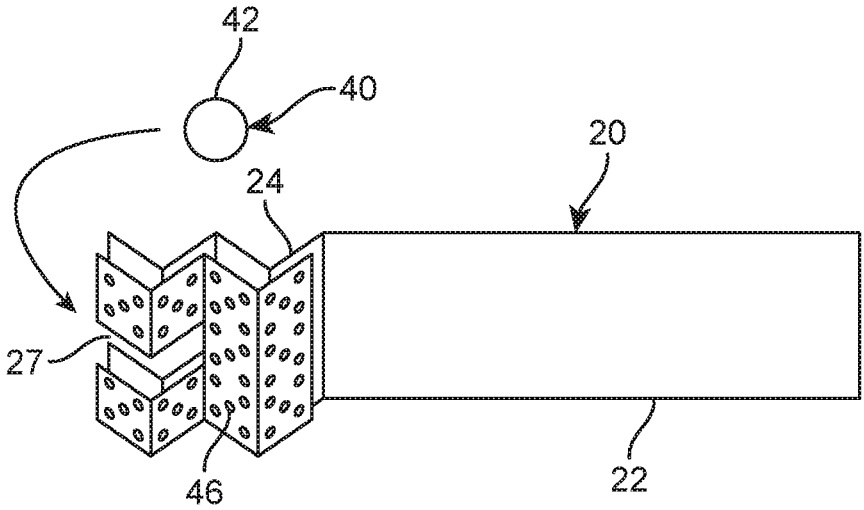
FIG. 11 shows a front view of top assembly 20 depicting a corrugated section with an additional absorbent layer in accordance to an embodiment of the present invention.

FIG. 11 of the provided drawings feature yet another embodiment of the present invention. The embodiment features an absorbent layer 46 which is positioned over corrugated section 24. In one implementation, absorbent layer 46 has a structure that matches the structure of corrugated section 24. In another implementation, absorbent layer 46 may only partially cover a portion of corrugated section 24. Furthermore, absorbent layer 46 may be made of a cotton or absorbent material. Any suitable absorbent material may be used for absorbent layer 46. Additionally, absorbent layer 46 may be provided as a perforated absorbent layer. However, other embodiments may feature a solid uniform absorbent layer 46. Other embodiments may feature a combination of a perforated corrugated section 24 and a perforated absorbent layer 46. In the present embodiment, absorbent layer 46 is placed over corrugated section 24 as observed in FIG. 11 of the present invention. Flavor capsule 42 is then nested between the cutout portion of corrugated section 24 having absorbent layer 46. Tip sheet 22 is then formed into a rolled configuration where the capsule may then be crushed to release the liquid flavored substance therein. The liquid substance is then absorbed and retained by absorbent layer 46 to enhance the smoking experience of a user.

In yet another embodiment of the present invention, a tip having a corrugated section is provided. A drill may then be used to form an opening within the tip from an outer surface. The flavor capsule is then inserted and secured within the opening formed from the drill. The capsule may then later be crushed to release the flavored liquid substance held therein.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for a pre-rolled tip, comprising:

a. a tip assembly including a tip sheet having a corrugated section defined by a plurality of crease lines, a cutout made into said corrugated section; and b. a capsule assembly including at least one capsule nested within said cutout, said corrugated section forming a pattern which supports said at least one capsule when said tip sheet is formed into a rolled configuration, said at least one capsule containing a liquid substance with a particular flavor therein.

2. The system for a pre-rolled tip of claim 1 wherein said tip sheet is one of a rectangular tip sheet or a trapezoidal tip sheet, wherein said cutout is one of a horizontal cutout or a vertical cutout.

3. The system for a pre-rolled tip of claim 1 wherein said at least one flavor capsule is enveloped within a cotton or absorbent material when nested within said cutout.

4. The system for a pre-rolled tip of claim 1 wherein said corrugated section includes an absorbent layer.

5. The system for a pre-rolled tip of claim 1 wherein said corrugated section is a perforated corrugated section.

6. A pre-rolled tip, comprising:

a. a first section being a uniform flat section;

b. a second section being a foldable section with crease lines to form a corrugated pattern; and c. a third section including two foldable extensions which are separated by a channel, wherein said channel begins along a lateral edge of said third section, wherein said channel includes a flavor capsule nested therein.

7. The pre-rolled tip of claim 6 wherein said channel includes a distal end and a proximal end, said distal end being an open end, wherein said proximal end is a lateral edge of said second section.

8. A system for a pre-rolled tip, comprising:

a. a tip assembly including a tip sheet having a corrugated section defined by a plurality of crease lines, a cutout made into said corrugated section; and b. a capsule assembly including at least one capsule nested within said cutout, said corrugated section forming a pattern which supports said at least one capsule when said tip assembly is formed into a rolled configuration, said at least one capsule containing a liquid substance with a particular flavor therein.

* * * * *